US005150015A

United States Patent [19]

Heindl et al.

[11] Patent Number: 5,150,015

[45] Date of Patent: Sep. 22, 1992

[54] ELECTRODELESS HIGH INTENSITY DISCHARGE LAMP HAVING AN INTERGRAL QUARTZ OUTER JACKET

[75] Inventors: Raymond A. Heindl, Euclid; Mark E. Duffy; James T. Dakin, both of Shaker Heights, all of Ohio; Harald L. Witting, Burnt Hills, N.Y.; Richard C. Nagle, Euclid, Ohio; Lawrence T. Mazza, Mayfield Heights, Ohio

[73] Assignee: General Electric Company, Schenectady, N.Y.

[21] Appl. No.: 685,371

[22] Filed: Apr. 15, 1991

[51] Int. Cl.[5] ..... H05B 41/24

[52] U.S. Cl. ..... 315/248; 315/344

[58] Field of Search ..... 315/248, 39, 344, 267; 313/234, 607

[56] References Cited

U.S. PATENT DOCUMENTS

| | | | |
|---|---|---|---|
| 4,647,821 | 3/1987 | Lapatovich | 315/248 |
| 4,810,938 | 3/1989 | Johnson | 315/248 |
| 4,871,946 | 10/1989 | Witting | 315/248 |
| 4,890,042 | 12/1989 | Witting | 315/248 |
| 4,972,120 | 11/1990 | Witting | 315/248 |
| 4,982,140 | 1/1991 | Witting | 315/248 |
| 5,032,757 | 7/1991 | Witting | 315/248 |
| 5,057,750 | 10/1991 | Farrall | 315/248 |
| 5,059,868 | 10/1991 | El-Hamamsy | 315/248 |

*Primary Examiner*—Eugene R. LaRoche
*Assistant Examiner*—A. Zarabian
*Attorney, Agent, or Firm*—George E. Hawranko; Stanley C. Corwin

[57] ABSTRACT

An electrodeless high intensity discharge (HID) lamp having an arc tube, a starting aid, and an outer jacket all integrally formed of fused quartz, includes an excitation circuit for providing RF energy effective for initiating and maintaining a gas discharge within the arc tube. The arc tube is positioned within the outer jacket such that a minimum space exists between the outer jacket and the arc tube thereby allowing the efficient coupling of such RF energy to the arc tube by means of an excitation coil wound in close proximate location to the arc tube. The starting aid is of a substantially smaller dimension than the arc tube thereby allowing for a second spacing to occur above the arc tube. This second spacing is effective for optimum thermal management of heat generated within the outer jacket. The upper end of the outer jacket has an integrally formed annular groove for receiving an annular support member effective for securing the HID lamp to a lighting fixture.

17 Claims, 1 Drawing Sheet

ELECTRODELESS HIGH INTENSITY DISCHARGE LAMP HAVING AN INTERGRAL QUARTZ OUTER JACKET

FIELD OF THE INVENTION

This invention relates to an electrodeless high intensity discharge lamp having an integral quartz outer jacket. More particularly, this invention relates to such a high intensity discharge lamp in which the outer quartz jacket is configured and positioned relative to the inner arc tube in such a manner as to allow for an efficient energization between the ballast circuit and the arc tube.

BACKGROUND OF THE INVENTION

High Intensity Discharge (HID) lamps have found widespread application in a number of commercial and industrial settings not only because of their obvious quality of providing a high intensity light source but also because such high intensity light output has been achieved with a high degree of luminous efficacy measured in terms of lumens per watt (LPW) and further because the color rendering capabilities of such lamps have proven to be quite acceptable. In typical HID lamp, a medium to high pressure ionizable gas is caused to emit visible wavelength radiation by the passage of current through a pair of electrodes which are disposed within the arc tube containing the gas. In response to the fact that such electrodes may be subject to energy loss, evaporation and chemical attack by the gas constituents of the arc tube, recent design efforts have been directed along the lines of removing the electrodes altogether.

In a typical electrodeless HID lamp which is inductively driven, the configuration will include a coil disposed around a bare quartz arc chamber containing the ionizable gas. The plasma within the arc chamber will be excited by a high frequency inductively coupled magnetic field. Of course it can be appreciated that an electrodeless HID lamp can be driven by a capacitively coupled electric field as well. An example of an electrodeless HID lamp of the inductively coupled design can be found in U.S. Pat. No. 4,972,120 issued to Witting on Nov. 20, 1990 and assigned to the same assignee as the present invention. As described in this cited reference, the arc tube is surrounded by a coil and is supported by means of a rod member.

The lack of an outer jacket relative to the bare arc tube described in the above cited reference can have a number of disadvantages to the practical, commercial application of this technology to an HID lamp offered in the marketplace. For instance, a bare arc tube may be easily susceptible to actual physical damage particularly in view of the fact that the HID lamp must ultimately be placed in a lighting fixture in order to have a practical use. Additionally, it is known that, with a bare arc tube typically constructed of quartz, hydrogen, oxygen and/or water vapor from the ambient air may diffuse into the arc chamber thereby affecting the mixture of gas constituents within the arc tube. Then there is a related problem that the bare quartz arc tube may be subject to surface contamination which can cause the devitrification of the quartz material that forms the arc chamber. One way to avoid the above discussed problems of a bare arc chamber used for an electrodeless HID lamp is the provision of an outer jacket which surrounds the arc chamber. An example of an electrodeless HID lamp having an outer jacket in addition to the arc chamber can be found in U.S. Pat. No. 4,810,938 issued to Johnson et al. on Mar. 7, 1989 and assigned to the same assignee as the present invention. Though this earlier patent does disclose the use of an outer jacket in surrounding relation to the arc chamber, the primary emphasis of this patent is toward the combination of arc tube materials which result in the improved efficacy and color rendition performance characteristics of the lamp. What discussion there is in this reference relating to the structure of the lamp is directed to the desirability of improving the shape of the arc tube such that, in cooperation with the designated fill constituency, the arc tube operates essentially as an isothermal device; that is, the arc tube will not experience the same thermal losses found in a typical electroded HID lamp. To further insure the optimum thermal performance of this electrodeless HID lamp, this patent discloses the use of a thermal energy barrier means between the arc tube and the outer jacket. This reference does not discuss any manner of applying the HID lamp to a lighting fixture nor an alternative approach to thermal management of the heat generated within the outer jacket by the discharge occurring within the arc tube upon excitation of the gases contained therein.

It would be advantageous if an electrodeless HID lamp having an outer jacket disposed in surrounding relation to the arc tube also provided a more practical solution to the issue of mounting the lamp within a lighting fixture and moreover, provided such an electrodeless HID lamp with a thermal management characteristic that did not interpose additional elements between the arc tube and the coil that could otherwise interfere with the excitation of the gas within the arc tube. An example of an electrodeless HID lamp having an efficient coupling between the arc tube and the coil and also illustrating the use of an outer jacket to avoid some of the previously discussed problems experienced by bare arc tubes, can be found in U.S. Pat. No. 4,871,946 issued to Witting et al. on Oct. 3, 1989 and assigned to the same assignee as the present invention. In this patent, it can be seen that the coil is disposed within the outer jacket thereby requiring that, as between the coil leads and the outer jacket, there must be a metal to glass sealing arrangement to insure the integrity of the inner portion of the outer jacket. It would be advantageous if an electrodeless HID lamp having an outer jacket could be provided wherein the need for a metal to glass seal could be avoided altogether.

Other examples of electrodeless HID lamps can be found in U.S. Pat. Nos. 4,894,589 and 4,894,590 which issued on Jan. 16, 1990 and are assigned to the same assignee as the present invention. It will be noted that these inventions are primarily directed to the manner in which the plasma arc discharge is started by means of introducing an initial high voltage pulse over a pair of starting electrodes disposed in close proximity to the coil and the arc tube. Both of these patents illustrate the use of a bare arc tube and there is no discussion as to whether the starting techniques of these inventions could be applied to an electrodeless HID lamp having an outer jacket surrounding the arc tube. An example of an invention which could be used in such a situation can be found in U.S. patent application Ser. No. 07/622,026 filed on Dec. 4, 1990 for a Discharge Starting Aid for an Inductively Coupled Arctube and assigned to the same assignee as the present invention. This application discusses an arrangement for starting the electrodeless HID lamp without the need for electrodes. It would be further advantageous if an electrodeless HID lamp having an outer jacket could accommodate the use of an electrodeless starting aid and still provide for the ability to mount the lamp in a practical lighting fixture and achieve optimum thermal performance characteristics without interference between the arc tube and the excitation coil.

OBJECTS OF THE INVENTION

It is therefore an object, of this invention to provide an electrodeless high intensity discharge lamp having an arc tube that is surrounded by an outer jacket preferably of the same material as the arc tube itself.

It is a further object of this invention to provide such a discharge lamp as includes a physical, structural provision for the mounting of such lamp within a lighting fixture so as to be applicable in a commercial setting.

Still another object of the invention is the provision of a discharge lamp which includes a starting aid arrangement which itself is electrodeless and which further allows for the positioning of the arc tube within the outer jacket in a manner to achieve the optimum placement of the excitation coil relative to the arc tube.

An even further object of the invention is to provide such a discharge lamp as utilizes the spacing between the outer jacket and the arc tube in a manner to improve the thermal conduction and convection of heat within such spacing without the need for adding elements to assist in such thermal management that could otherwise have a negative impact on the coupling of the excitation coil to the arc tube.

Yet a further object of the invention is to provide such a discharge lamp as achieves the optimum efficacy and color rendering characteristics possible and yet also prevents the emission of UV radiation from the gas discharge and further prevents the diffusion of hydrogen into the arc tube.

An even further object of the invention is to provide such a discharge lamp as utilizes a non-metallic material construction of the arc tube, outer jacket and starting aid and does so by forming such arc tube, outer jacket and starting aid integrally of fused quartz.

SUMMARY OF THE INVENTION

In accordance with the principals of the present invention, there is provided an electrodeless high intensity discharge lamp which includes an arc tube containing a fill of ionizable gas. Upon energization by means of a high frequency RF signal, the ionizable gas is excited into a gas discharge state thereby emitting visible radiation. The electrodeless HID lamp further includes a starting aid which is effective for providing initiation of the gas discharge within the arc tube. An outer jacket is disposed in surrounding relation to a large portion of the arc tube such that a minimum spacing exists between the arc tube and the outer jacket. An excitation coil is wound around the exterior of the outer jacket at the point where there is such minimum spacing between the outer jacket and the arc tube thereby insuring the efficient coupling of RF energy from the excitation circuitry to the arc tube. The starting aid is of substantially smaller dimension than the arc tube and extends cutward from the arc tube such that it exits the outer jacket at one end thereof. In this manner, the space above the arc tube within the outer jacket is of sufficient size to address the necessary convection and/or conduction and/or radiation of heat generated by the gas discharge. Additionally, the starting aid is sealed at the point of exiting the outer jacket in a manner which precludes the need for a metal-to-glass seal and further, provides support for the arc tube thereby preventing movement of the arc tube away from the spaced relation to the excitation coil. Also formed at the one end of the outer jacket is an annular retaining groove which is effective in conjunction with a support member, for securing the electrodeless HID lamp in a lighting fixture.

DESCRIPTION AND OPERATION

Figure 1:
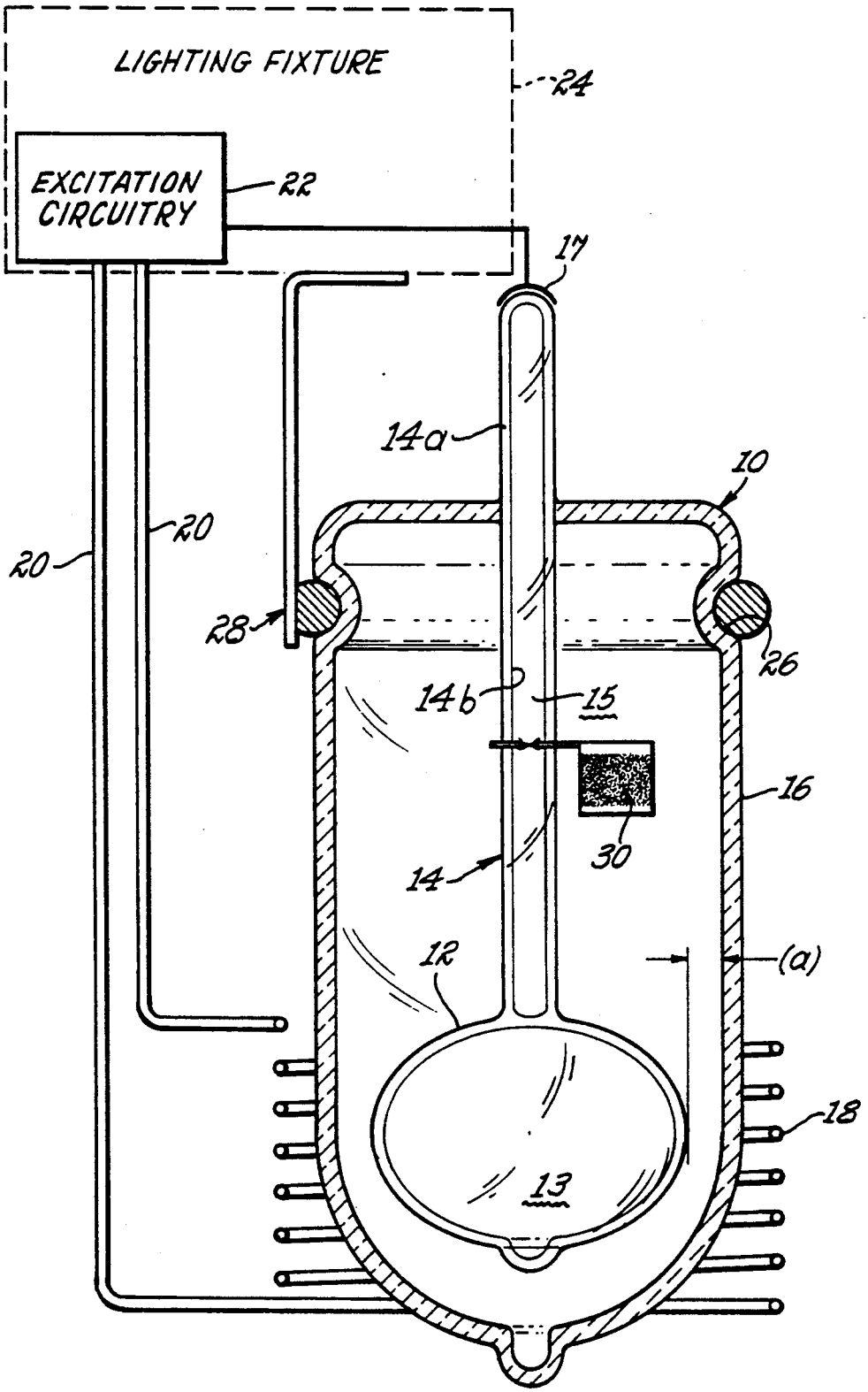
FIG. 1 is an elevational view partly in cross-sectional form of an electrodeless HID lamp and associated lighting fixture hardware constructed in accordance with the present invention.

As shown in FIG. 1, the electrodeless high intensity discharge (HID) lamp shown generally as reference number 10, includes an arc tube 12 of a generally oblate spheroidal shape. The arc tube shape is selected to minimize temperature gradients around the arc tube 12; that is, this shape provides for a maximum cold spot temperature required for adequate halide vapor pressures, and a minimum hot spot temperature which insures long lamp life. For a more detailed discussion of the shape characteristics of the arc tube 12, reference is hereby made to the previously noted U.S. Pat. No. 4,810,938 which is incorporated herein by reference. The arc tube 12 is preferably constructed of a high temperature glass material such as fused quartz or alternatively, an optically transmissive ceramic such as polycrystalline alumina. Typical electroded HID lamps will include an outer jacket made of hard glass; because of the high temperatures at which an electrodeless HID lamp must operate, such a material would be inappropriate. The arc tube 12 will contain a fill including volatile condensate and constituent gases 13 which will preferably include a combination of one or more metal halides and a buffer gas which is typically an inert gas such as krypton or xenon. The fill constituents are combined in proper weight proportions to achieve the desirable efficacy and color temperature performance characteristics of the gas discharge which will be generally toroidal in shape. For a more detailed discussion of design criteria for the selection and proportions of the fill material, reference is hereby made to the previously noted U.S. Pat. No. 4,972,120 which is hereby incorporated by reference.

As viewed in FIG. 1, extending in the upwardly direction from the arc tube 12, is a starting aid 14 which is joined to the arc tube 12 and is constructed of the same fused quartz material as the arc tube 12. The starting aid 14 consists of the tubular extending member **14*a* which is substantially smaller in dimension than the arc tube 12 and has a hollow center 14*b* in which is contained a low pressure gas or mixture of gases. The gas fill 15 in the starting aid 14 has a lower dielectric breakdown value than the gas fill 13 contained in the arc tube 12. Accordingly, upon energization of the electrodeless HID lamp 10, the starting aid fill 15 will first experience a dielectric breakdown and go into a state of electric discharge thereby serving as a means for initiating the electric discharge within the arc tube 12. The dielectric breakdown of the starting aid fill 15 can be initiated by application of RF energy to an electrical contact 17 disposed externally at the top portion of the starting aid tube 14***a*. In this manner, it can be appreciated that there is no electrode inserted within the arc tube 12 or the starting aid tube 14*a* thereby obviating the need for a metal to glass (quartz) seal that could otherwise weaken the structure of either the arc tube 12 or starting aid tube 14*a*. Of course, it can be appreciated that other approaches to initiating dielectric breakdown within the starting aid tube 14*a* may be practiced without departing from the scope of the present invention. For instance, an alternate approach may include the insertion of an electrode into the hollow center 14*b* of the starting aid 14 which would still benefit from the disclosure contained herein relating to the use of an integrally constructed arc tube 12 and starting aid 14 precluding the need for a glass-to-metal seal between such two components since such electrode is inserted externally of the arc tube 12 and an outer jacket 16. In other words, one could insert an electrode into the starting aid center 14*b* and yet still provide a non-metallic configuration as between the arc tube, outer jacket and starting aid thereby obviating the need for a glass-to-metal seal interfering in such structural relationship.

The outer jacket 16 also formed of the same fused quartz material as the arc tube 12 and the starting aid 14, is disposed in surrounding relation to the arc tube 12, starting aid 14 configuration. It can be appreciated that though this embodiment preferably utilizes a fused quartz material, it is possible to practice the present invention by use of like materials that are light transmissive and operate in a high temperature setting. For instance, high temperature glass may be used entirely for certain components or in combination with the fused quartz if a graded seal is also utilized to counter any problems associated with thermal expansion properties of the different materials.

The outer jacket 16 is of an essentially elongated construction to allow for the length of the starting aid 14 and further to allow for the thermal management of heat within the outer jacket 16 as will be discussed hereinafter in further detail. The lower portion of the outer jacket 16 is configured having an arcuate shape conforming substantially to the form of the spheroidally shaped arc tube 12. In this manner, the portion of the outer jacket 16 which surrounds the arc tube 12 can be sized such that a minimum spacing, designated (a) in FIG. 1, will exist between the arc tube 12 and the interior surface of the outer jacket 16. At the upper portion of the outer jacket 16, the structure is more uniform in dimension and, in cooperation with the fact that the starting aid tube 14*a* is substantially smaller in dimension than the arc tube 12, a larger internal spacing 16*a* exists between the starting aid tube 14*a* and the internal wall of the upper portion of the outer jacket 16. Being disposed in a higher position than the arc tube 12 and given the size of the larger internal spacing 16*a*, the outer jacket 16 configuration of the present invention provides a thermal management arrangement whereby thermal losses from the arc tube 12 as caused by heat convection and/or conduction and/or radiation can be effectively controlled within the outer jacket 16.

The fused quartz which is used for the outer jacket 16, the arc tube 12 and the starting aid 14 may be doped with one or more rare earth oxides for the purpose of blocking UV emissions from the electrodeless HID lamp 10. Of course, the doping of the material for the outer jacket 16 only, or the arc tube 12 only, may serve the same purpose of preventing the emission of UV radiation.

At the upper end of the outer jacket 16, an essentially flat surface is provided through which the top end of the starting aid tube 14*a* exits the outer jacket 16 such that an electrical contact (now shown) can be coupled to the starting aid 14 without the need for invading the internal spacing of the outer jacket 16. In this preferred manner, the fused quartz outer jacket 16 and the starting aid 14 also made of fused quartz, can be hermetically sealed without the need for a graded seal or other means which would require a provision to eliminate thermal expansion mismatches between lamp components. Additionally, by the sealed exit configuration between the top end of the starting aid tube 14*a* and the outer jacket 16, the outer jacket 16 provides necessary support to the starting aid 14 and consequently the arc tube 12 which is joined to the starting aid 14. The support provided by the outer jacket 16 to the arc tube 12 is provided in an indirect manner but is effective for preventing relative movement between the arc tube 12 and the lower portion of the outer jacket 16.

The positioning of the arc tube 12 within the lower portion of the outer jacket 16 is important for the purpose of allowing the efficient coupling of RF energy to the arc tube to maintain the gas discharge. In order to insure maximum coupling of the RF energy to the gas discharge, it has been determined that the spacing (a) between the arc tube 12 and the outer jacket 16 should be kept as small as possible and preferably, to a value less than 2.0 millimeters. Additionally, for the same purpose of insuring maximum RF coupling, it has been determined that the thickness of the quartz used for the outer jacket should also be kept to a minimum and, preferably less than 2.0 mm.

Based on the above preferred dimensions for the distance between the arc tube 12 and the outer jacket 16 and the thickness of the outer jacket 16, the maximum efficiency in coupling the RF energy to the arc tube 12 is achieved by placement of the excitation coil 18 in surrounding relation to the lower portion of the outer jacket 16. The excitation coil 18 is connected to the excitation circuitry 22 over lead wires 20. The excitation circuitry 22 can include an RF power supply (not shown) which, in operation, provides current to excitation coil 18 which results in a changing magnetic field. The changing magnetic field will produce an electric field within the arc tube 12 which substantially closes upon itself. As a result of this induced electric field, an arc discharge is produced within the arc tube 12 in the shape of a toroidal arc discharge. To achieve this induced electric field that produces the toroidally shaped arc discharge, the operating frequency of the excitation circuitry 22 can be within the range of 1 megahertz to 300 megahertz and is preferably, 13.56 megahertz or other ISM band frequencies.

In order to achieve a commercially practical application of the electrodeless HID lamp, it is necessary to place the lamp in a lighting fixture 24 which will serve as the housing for the excitation circuitry 24 as well as any associated optical devices such as a refractor and/or reflector (not shown). The lighting fixture 24 can also be equipped with an arrangement for dissipating heat (not shown) generated by the components connected thereto. Also connected to lighting fixture 24 is a connecting member 28 which is effective for securing the electrodeless HID lamp 10 to the lighting fixture 24. The connecting member includes an L-shaped portion secured to the lighting fixture 24 and an annular shaped portion disposed in surrounding relation to an annular retaining groove 26 formed in the one end of the outer jacket 16. A suitable material or material coating can be used on the annular portion of the connecting member 28 so as to prevent damage to the fused quartz material of the outer jacket 16.

In operation, the outer jacket 16 of the electrodeless HID lamp 10 is evacuated to a very low pressure, for instance, a pressure less than $1\times10^{-4}$ torr in order to reduce heat loss from the arc tube 12 which may be caused by convection and/or conduction. The low pressure state of the interior of the outer jacket 16 will further be effective for eliminating any discharge which might otherwise be excited in the space between the outer jacket 16 and the arc tube 12. In this reduced pressure condition, it may be necessary to include a small quantity of a hydrogen getter material shown in FIG. 1 as reference 30. The hydrogen getter 30 may be an aluminum/zirconium alloy and is contained within the outer jacket 16 in such a position as to maintain an appropriate temperature while the electrodeless HID lamp 10 is in steady state operation. The getter 30 is effective for absorbing any hydrogen which may diffuse in through the outer jacket 16 or out through the arc tube 12. Prevention of hydrogen buildup is necessary to insure long lamp life and performance and also, since excessive hydrogen buildup within the outer jacket 16 may result in the initiation of a discharge preferentially within the outer jacket 16, such a condition must be avoided so as to allow the preferential occurrence of the discharge within the arc tube 12. It can be appreciated that, except for the material comprising the getter 30, there is no metallic material used in the electrodeless HID lamp 10 thereby providing this lamp with the advantage that, in the presence of the intense RF fields generated by the excitation circuitry 22, there is no metal to absorb energy that would result in a reduced system efficiency.

As an alternate operational approach to utilizing the electrodeless HID lamp 10 in a low pressure state disclosed herein, the outer jacket 16 may be filled with an inert gas, such as nitrogen, at sufficiently high pressure, such as 500 torr at room temperature, to prevent a discharge from occurring in the space between the outer jacket 16 and the arc tube 12. Additionally, a gas fill of this type would reduce the time required for the electrodeless HID lamp 10 to cool to restarting temperature after being extinguished. As previously discussed, operation of the HID lamp 10 in a high pressure state requires that for thermal management purposes, the heat generated by the arc discharge be radiated outward from the outer jacket 16. Though such an approach may entail the occurrence of increased thermal losses and therefore, a decreased efficiency, such an approach would provide the benefit of obviating the need for a getter 30 altogether.

Although the hereinabove described embodiment of the invention constitutes a preferred embodiment of the invention, it should be understood that modifications can be made thereto without departing from the scope of the invention as set forth in the appended claims. For instance, regarding the shape of the arc tube, it may be possible to use alternate configurations rather than the spheroidal shape; it may be possible to utilize a sectioned cylindrical shape (i.e. "pill box") or a mushroom shape. Additionally, it may be possible to more closely conform the shape of the outer jacket to that of the starting aid and still maintain efficient thermal management properties.

What we claim as new and desired to secure by letters patent of the United States is:

1. An electrodeless high intensity discharge lamp comprising:

an arc tube containing a fill of ionizable gas;

means for aiding in the starting of said gas discharge, said aiding means including a starting member disposed in close proximity to said arc tube and being of a dimension substantially narrower than said arc tube;

an outer jacket disposed in surrounding relation to a portion of said arc tube and only a portion of said starting member, said outer jacket being of a dimension such that a first, minimum spacing exists between said arc tube and said outer jacket and a second spacing exists between said at least a portion of said starting member and said outer jacket, said first, minimum spacing between said arc tube and said outer jacket allowing for the positioning of said exciting means in close proximity to said arc tube and said second spacing between said outer jacket and said at least a portion of said starting member allowing for thermal management of heat generated by said gas discharge, said starting member further being supported within said outer jacket without the use of metallic components; and wherein said arc tube, said starting member and said outer jacket are composed of like non-metallic materials.

2. A discharge lamp as set forth in claim 1 wherein said starting member is interposed in a contacting relation between said arc tube and said outer jacket such that said starting member provides support for said arc tube and prevents movement of said arc tube away from the spaced relation with said exciting means.

3. A discharge lamp as set forth in claim 1 wherein said like non-metallic material is fused quartz and said arc tube, outer jacket and starting member are integrally formed therefrom.

4. A discharge lamp as set forth in claim 3 wherein said arc tube is essentially spheroidally shaped and said starting member extends outward therefrom.

5. A discharge lamp as set forth in claim 4 wherein said outer jacket is essentially tubular in shape and said starting member extends along the longitudinal axis of said outer jacket so as to exit said outer jacket at one end portion thereof.

6. A discharge lamp as set forth in claim 5 further comprising an annular retaining groove formed around one end portion of said outer jacket, said annular retaining groove being receptive of a support member effective for supporting said discharge lamp within a lighting fixture.

7. A discharge lamp as set forth in claim 1 wherein said excitation means includes an excitation coil disposed in close proximity to the portion of said outer jacket which is in close spaced relation with said arc tube.

8. A discharge lamp as set forth in claim 5 wherein a hermetic seal is provided between said starting member and said outer jacket and said hermetic seal is achieved absent the use of a metallic material.

9. A discharge lamp as set forth in claim 3 wherein said outer jacket has associated therewith, one or more materials which impart said outer jacket with an ability to block UV radiation from being emitted from said discharge lamp.

10. A discharge lamp as set forth in claim 1 wherein said spacing between said arc tube and said outer jacket is maintained at a substantially low pressure value so as to prevent the occurrence of a discharge within said spacing.

11. A discharge lamp as set forth in claim 10 further comprising a getter member residing within said outer jacket so as to sorb any hydrogen which may diffuse into said spacing between said arc tube and said outer jacket.

12. A discharge lamp as set forth in claim 1 further comprising a fill of high pressure inert gas contained within said spacing between said outer jacket and said arc tube, said inert gas fill being effective such that a discharge occurs preferentially within said arc tube rather than the spacing between said arc tube and said outer jacket.

13. An electrodeless high intensity discharge lamp comprising:

an arc tube containing a fill of ionizable gas;

means for exciting said fill of ionizable gas such that a gas discharge occurs;

an outer jacket disposed in surrounding relation to a portion of said arc tube and being of a dimension such that a first, minimum spacing exists between said arc tube and said outer jacket thereby allowing said exciting means to be disposed in close proximate relation to said arc tube;

a support member interposed in contacting relation between said arc tube and said outer jacket, said support member only partially residing within said outer jacket and being of a dimension which is substantially smaller than the dimension of said arc tube such that a second space is formed within said outer jacket between said support member and said outer jacket, said support member being mounted to said outer jacket without the use of metallic components and further being effective such that relative movement between said arc tube and said outer jacket is prevented thereby; and wherein said arc tube, said outer jacket and said support member are composed of like non-metallic materials.

14. A discharge lamp as set forth in claim 13 wherein said arc tube is essentially spheroidally shaped and said support member extends outward therefrom.

15. A discharge lamp as set forth in claim 13 wherein at least said outer jacket and said support member are composed of fused quartz as such non-metallic material.

16. A lighting fixture comprising:

an electrodeless high intensity discharge lamp;

said electrodeless high intensity discharge lamp including an arc tube containing a fill of ionizable gas;

means for exciting said ionizable gas such that a gas discharge occurs;

said electrodeless high intensity discharge lamp further including:

means for aiding in the starting of said gas discharge, said aiding means including a starting member disposed proximate to said arc tube;

an outer jacket disposed in surrounding relation to a portion of said arc tube and being of a dimension such that a first, minimum spacing exists between said arc tube and said outer jacket thereby allowing said exciting means to be disposed in close proximate relation to said arc tube;

said outer jacket, said starting member having a portion thereof extending outward of said outer jacket and being supported by said outer jacket without the use of metallic components and said arc tube are integrally formed of a like non-metallic material;

a housing in which said means for exciting said ionizable gas is disposed;

means for securing said electrodeless high intensity discharge lamp to said housing; and a support member secured to said housing and extending so as to engage said securing means in a surrounding clamped relation.

17. A lighting fixture as set forth in claim 16 wherein said exciting means includes an excitation coil disposed in surrounding relation to a portion of said outer jacket corresponding to said first minimum spacing between said outer jacket and said arc tube, said exciting means further including means for generating an RF signal of appropriate magnitude and frequency so as to maintain said gas discharge within said electrodeless high intensity discharge lamp.

* * * * *